US005335470A

United States Patent [19]

Alvarez

[11] Patent Number: 5,335,470

[45] Date of Patent: Aug. 9, 1994

[54] ADJUSTABLE BEAM HOLDER

[76] Inventor: Gustavo O. Alvarez, 1705 W. 42 St., #102, Hialeah, Fla. 33012

[21] Appl. No.: 10,046

[22] Filed: Jan. 28, 1993

[51] Int. Cl.[5] ..... E04B 1/38

[52] U.S. Cl. ..... 52/699; 52/92.2; 52/295; 249/213

[58] Field of Search ..... 52/92.1, 92.2, 92.3, 52/93.1, 93.2, 295, 699, 707; 249/213

[56] References Cited

U.S. PATENT DOCUMENTS

| | | | |
|---|---|---|---|
| 827,613 | 7/1906 | Brown | 52/707 |
| 1,280,485 | 10/1918 | Kahn . | |
| 1,599,335 | 9/1926 | Levens | 52/92.1 |
| 1,657,441 | 1/1928 | Huovinen | 52/92.2 X |
| 2,947,119 | 8/1960 | Puckett | 52/92.2 X |
| 3,000,145 | 9/1961 | Fine | 52/92.2 X |
| 4,736,554 | 4/1988 | Tyler | 52/295 X |
| 5,060,436 | 10/1991 | Delgado | 52/295 |
| 5,240,224 | 8/1993 | Adams | 52/699 X |

*Primary Examiner*—Carl D. Friedman
*Assistant Examiner*—Robert J. Canfield
*Attorney, Agent, or Firm*—J. Sanchelima

[57] ABSTRACT

An adjustable beam holder to be used with parallel spaced apart forming boards. The holder includes a case with a longitudinal slot that receives a headed threaded shank members and the other end of the shank is inserted through holes in the flanges of a clamp having a U-Shaped bracket. The bracket embraces one of the beams of a truss member urging same toward the case that is anchored in concrete. Readily detachable arms are mounted to the upper wall of the case member in order to rest over the edges of forming wall and thereby aligning the upper wall flush with the plane defined by the upper edges.

5 Claims, 3 Drawing Sheets

ADJUSTABLE BEAM HOLDER

BACKGROUND OF THE INVENTION

1. Field of the Invention

The present invention relates to beam holders, and more particularly, to those that are imbedded in concrete slabs or tie beams to anchor truss members.

2. Description of the Related Art

Several devices have been designed in the past to operate as anchors in concrete for other construction members or fixtures. However, none of them have been directed to the typical wooden trusses of a roof. The acts of God, in particular hurricanes, have proven to cause damages not imaginable as the wind forces are difficult to predict. The need to keep the truss members in place has become quite apparent in South Florida with the recent hurricane Andrew.

Applicant believes that the closest reference corresponds to U.S. Pat. No. 1,280,485 issued to Kahn. However, it differs from the present invention because it does not teach a device or method for supporting the beam of a truss member, anchorage members or removable arm members.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a device for readily installation on the forms of a tie beam to be poured so that it can be readily adapted to receive and anchor the members of a truss thereby forming a rigid assembly.

It is another object of this present invention to provide a device that can be adjusted to different dimensions of truss members and different angles of these members.

It is still another object of this present invention to provide a device that can be used single handed by a user.

It is yet another object of this present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
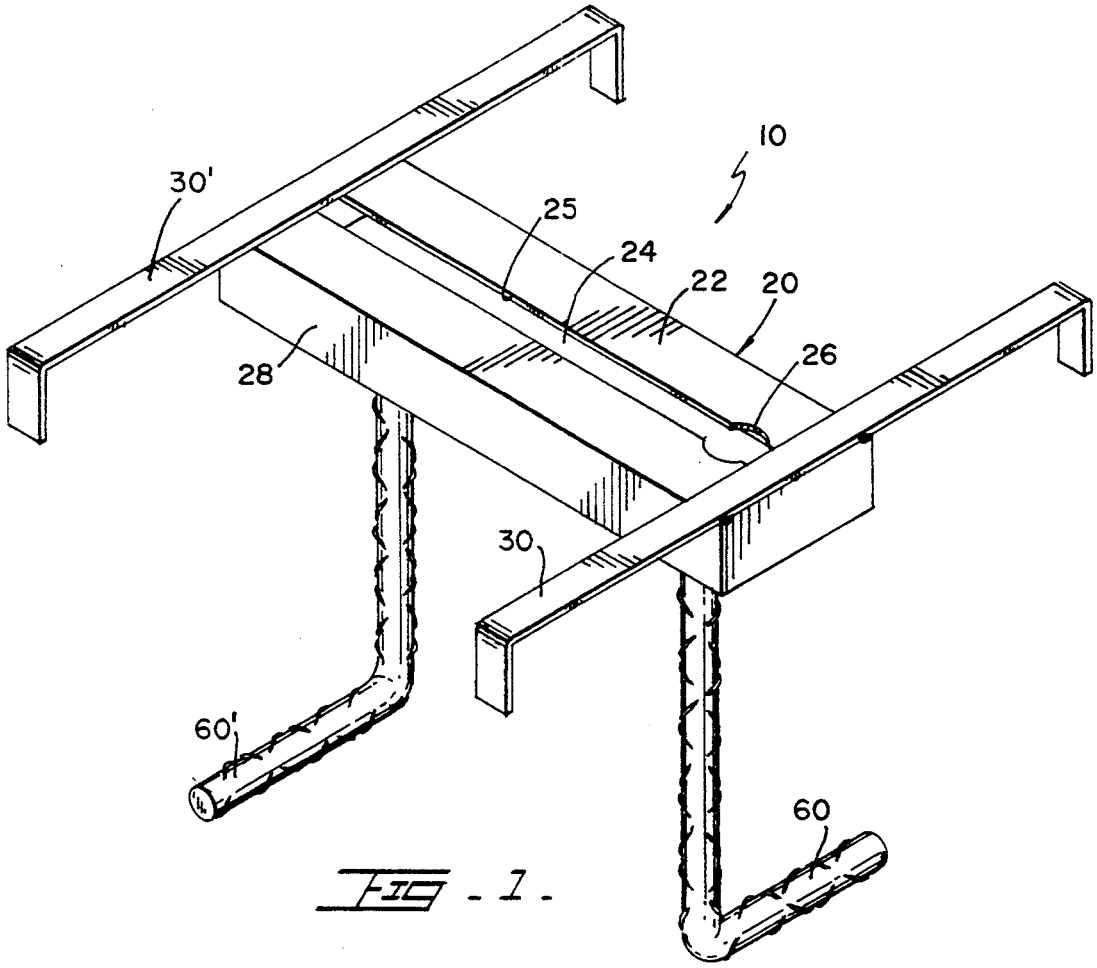
FIG. 1 represents an isometric view of the adjustable beam holder subject of the present application.
Figure 2:
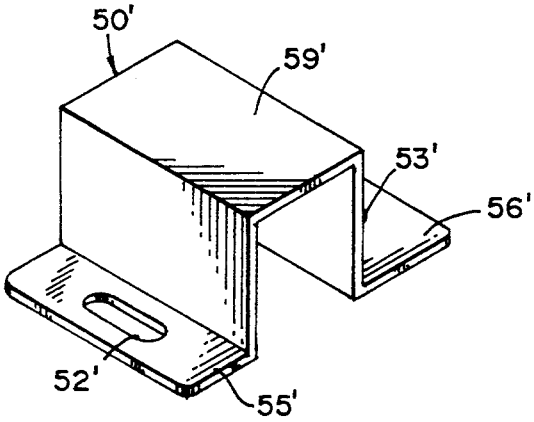
FIG. 2 shows an isometric view of the end clamp member used in one of the preferred embodiments to anchor the end truss members.
Figure 3:
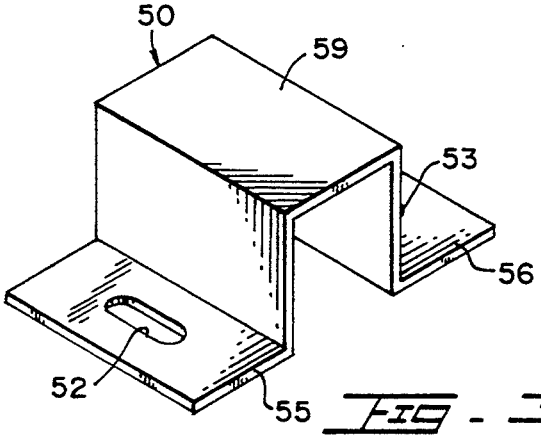
FIG. 3 illustrates an isometric view of the in-between clamp member used in one of the preferred embodiments to anchor the truss members that are not at the ends.
Figure 4:
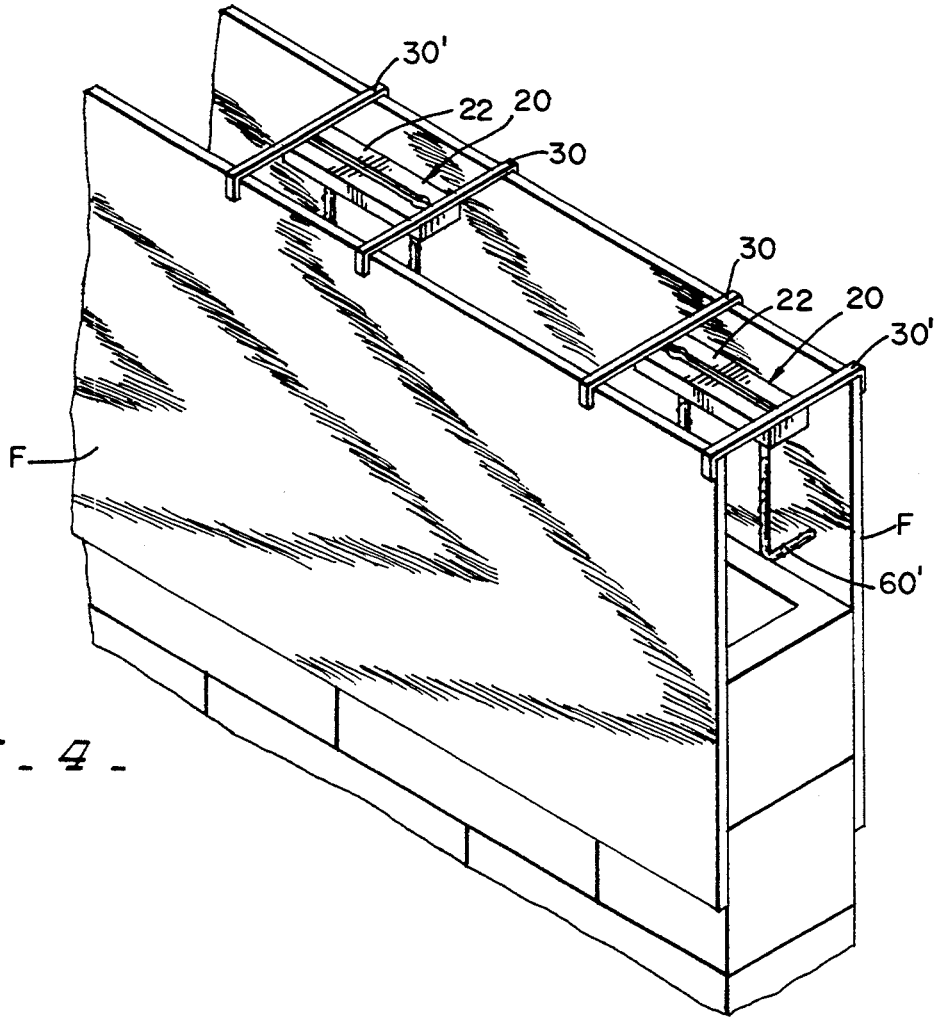
FIG. 4 is a representation of the adjustable beam holder subject of the present application mounted over forming boards and ready for concrete to be poured to form a tie beam.
Figure 6:
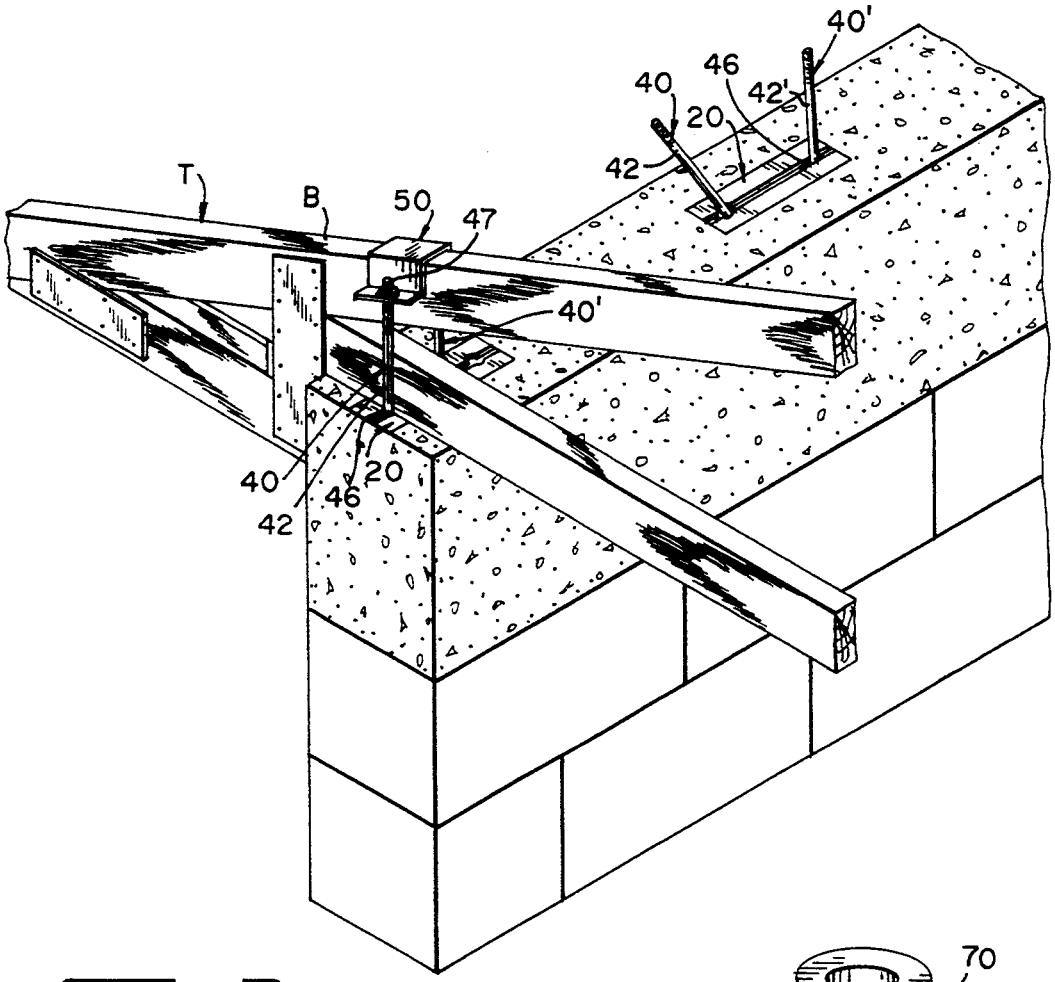
FIG. 6 represents an isometric view showing the present invention and part of a truss member from another angle in order to appreciate the relationship of its different members.

Referring now to the drawings, and in particular FIG. 1, where the present invention is generally referred to with numeral 10, it can be observed that it basically includes an elongated case 20 with a longitudinal slot 25 on its top wall 22. Case 20 includes top wall 22, bottom 24 and lateral wall 28 that define a space therein. Detachable arm members 30 and 30' are welded at the ends of case 20 in such a manner that they can be readily detached by hitting them with a hammer or similar tool. Preferably, arm members 30 and 30' are welded at one or two points only. Arm members 30 and 30' extend transversely across case 20 a sufficient distance to hang over the upper edges of forms F, as best seen in FIG. 4. In this manner, upper surface 22 is positioned flush with the upper surface of the concrete to be poured. Fastening assemblies 40 and 40' include threaded shanks 42 and 42', with two ends as best seen in FIG. 6. Shanks 42 and 42' extend a sufficient distance to permit it to pass through holes 52; 52'; 53 and 53' of clamp assemblies 50 and 50' as best seen in FIGS. 2 and 3. The other ends of shanks 42 and 42' have headed terminations 46 and 46' that are inserted inside case 20 through enlarged opening 26. Fastening assemblies 40 and 40' slide along slot 25. Anchorage members 60 and 60' are rigidly mounted to the bottom of case 20 and extend perpendicularly outwardly therefrom.

Figure 5A:
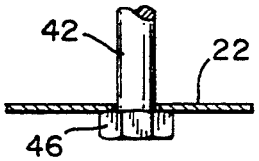
FIG. 5A is a detailed view of the headed shank inserted in the case.
Figure 5:
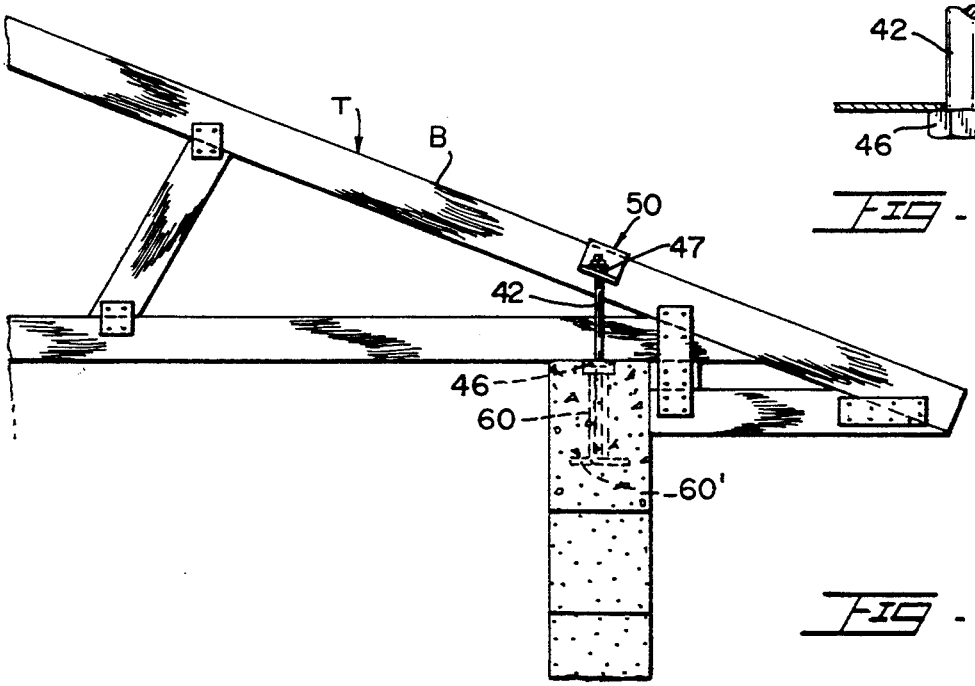
FIG. 5 is an elevational side view of a part of a truss member and adjustable beam holder with the removable arms detached and the holder showing one of the in-between clamp members anchoring the upper beam of a truss member.
Figure 7A:
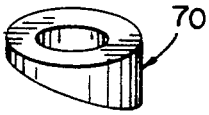
FIG. 7A shows a special wedge shaped washer used in with the fastening device shown in FIG. 7.
Figure 7:
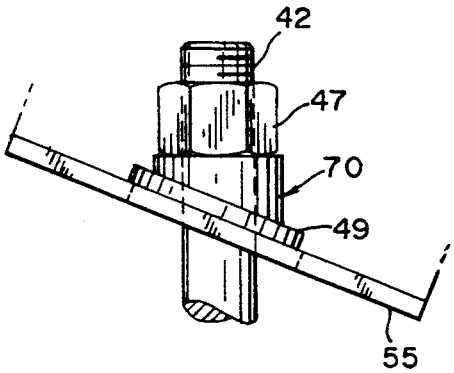
FIG. 7 is a detail view of the end of the fastening device used in the present invention in connection with a steep upper beam, such as the one used for cathedral ceilings.
Figure 8:
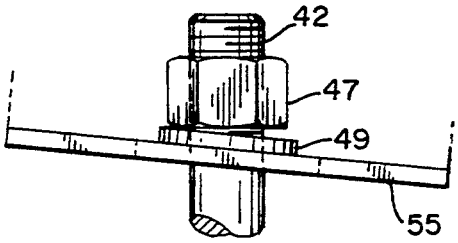
FIG. 8 shows the same device shown in FIG. 7 without the wedge shaped washer since the angle of the upper beam is not as steep in the standard application making the use of this special washer unnecessary.

In more detail, it can be seen in FIGS. 2 and 3 that end clamp member 50' looks like in-between clamp member 50, except that flange 55' is smaller than flange 55. In-between clamps 50 are those that are not placed at the ends where flange 55 needs to be somewhat narrower, like the one shown in FIG. 2 and referred to with numeral 55'. Flange 56 and 56' have, in the preferred embodiment, the same dimensions as flange 55. Outwardly extending flanges 55; 55'; 56 and 56' include 54 holes 52; 52'; 53 and 53' of cooperative dimensions to permit shanks 42 and 42' through. Clamp members 50 and 50' include U-shape brackets 59 and 59' that cooperatively receive the upper beam B of a truss member that is typically a 2"×4" or 2"×6" wood member. Nut 47 is tightened so that the upper beam B of a truss assembly T is embraced and urged downwardly towards case 20 as best seen in FIGS. 5; 6; 7 and 8. Washer 49 is used in the preferred embodiment to enlarge the contact surface where the tightening force is received. Depending on the angle of upper beam B with respect to the horizontal plane, it may be necessary to insert a wedge shaped spacer 70 to compensate for the uneven spacing between the underside of the nut and the washer that tends to align itself with the surface of flange 55 as seen in FIG. 7. Also, wedge shaped spacer 70 minimizes the bite of nut 47.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An adjustable beam holder adapted to be used with parallel spaced apart forming boards having upper edges aligned with respect to each other to define a plane and said holder being adapted to securely hold a truss assembly having a plurality of beams, comprising:

A) an elongated case member having two ends and said case member being defined by top, lateral and bottom walls defining a space therein and said top wall includes a longitudinally extending slot having an enlarged opening;

B) two detachable arm members transversely disposed across said case member and said detachable arm members adapted to rest over the upper edges of said forming boards;

C) anchorage means rigidly mounted to said bottom wall and said anchorage means extending perpendicularly and away from said bottom wall;

D) clamp means adapted to engage one of said beams of said truss assembly; and

E) fastening means for urging said clamp means towards said case member and said fastening means being removably and slidably mounted to said case member.

2. The adjustable beam holder set forth in claim 1 wherein said fastening means include a nut and a washer member and wherein said clamp means includes two flange members having each a hole that cooperatively receives said fastening means through and said flange members provide sufficient area to permit contact of said washer with said flange member to urge the latter towards said case member as said nut is advanced towards said case member.

3. The adjustable beam holder set forth in claim 2 wherein said fastening means includes a headed termination that is removably inserted through said enlarged opening and slidably movable along said slot to accommodate beams of varying widths.

4. The adjustable beam holder set forth in claim 3 wherein one of said flange members is narrower than the other one thereby permitting said holder to be used to hold the beams of the ends of the truss assembly.

5. The adjustable beam holder set forth in claim 4 further including a spacer member having the shape of a wedge to compensate for pronounced angles of beams being held with respect to the plane defined by said upper wall.

* * * * *